US010767481B2

(12) United States Patent
Clamp et al.

(10) Patent No.: US 10,767,481 B2
(45) Date of Patent: Sep. 8, 2020

(54) SELF-ADVANCING ROOF SUPPORT FOR A LONGWALL MINING SYSTEM

(71) Applicant: Caterpillar Global Mining Europe GmbH, Lünen (DE)

(72) Inventors: Patrick Clamp, Thornton (AU); Bradley Michael Stanaway, Idalia (AU)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 16/521,254

(22) Filed: Jul. 24, 2019

(65) Prior Publication Data

US 2020/0049006 A1 Feb. 13, 2020

(30) Foreign Application Priority Data

Aug. 7, 2018 (GB) ..... 1812805.8

(51) Int. Cl.
*E21D 23/00* (2006.01)
*E21D 23/26* (2006.01)
*E21D 23/08* (2006.01)

(52) U.S. Cl.
CPC ..... *E21D 23/0065* (2013.01); *E21D 23/26* (2013.01); *E21D 23/0073* (2013.01); *E21D 23/081* (2013.01)

(58) Field of Classification Search
CPC combination set(s) only.
See application file for complete search history.

(56) References Cited

U.S. PATENT DOCUMENTS 6,056,481 A * 5/2000 Watermann ..... E21D 23/16 405/288
6,945,738 B2 9/2005 O'quinn et al.
6,957,166 B1 10/2005 Howie et al.
(Continued)

FOREIGN PATENT DOCUMENTS

CN 104005774 A 8/2014
CN 104331531 A 2/2015
(Continued)

OTHER PUBLICATIONS

Search Report for related United Kingdom Application No. 1812805.8; dated Jan. 28, 2019.

*Primary Examiner* — Kyle Armstrong
(74) *Attorney, Agent, or Firm* — Miller, Matthias & Hull LLP; Joell R. Hibshman, II

(57) ABSTRACT

A self-advancing roof support for a longwall mining system includes a base, a hydraulic actuator having one end pivotally coupled to the base, and a canopy portion that is connected to another end of the hydraulic actuator. The roof support also includes a load sensor disposed on the canopy portion. The load sensor generates a signal indicative of an amount of load borne by the canopy portion in abutment with a roof of an underground mine site. A controller is communicably coupled to the load sensor and the hydraulic actuator. The controller determines if the signal from the load sensor is suggestive of a cavity adjacent to a zone above the canopy portion. Based on the determination, the controller actuates movement of the hydraulic actuator such that the canopy portion is displaced into a position underlying the cavity.

16 Claims, 4 Drawing Sheets

(56) References Cited

U.S. PATENT DOCUMENTS

| | | | | |
|---|---|---|---|---|
| 8,672,414 | B2 | 3/2014 | Junker et al. | |
| 2011/0049964 | A1* | 3/2011 | Junker | E21C 35/12 299/1.7 |
| 2016/0061036 | A1* | 3/2016 | Siegrist | E21D 23/066 340/666 |

FOREIGN PATENT DOCUMENTS

| | | | |
|---|---|---|---|
| CN | 105443157 | A | 3/2016 |
| CN | 206737954 | U | 12/2017 |
| GB | 2316973 | A | 3/1998 |

* cited by examiner

SELF-ADVANCING ROOF SUPPORT FOR A LONGWALL MINING SYSTEM

TECHNICAL FIELD

The present disclosure relates to a self-advancing roof support for a longwall mining system. More particularly, the present disclosure relates to a control system for autonomously controlling movement of a roof support that is associated with a longwall mining system.

BACKGROUND

Longwall mining systems have typically been using roof supports for controlling a roof of an underground mine. These systems use a moving longwall shearer to cut out a portion of a seam that is located in front of the shearer. However, if poor geological conditions exist when the shearer cuts out a portion of the seam, a cavity could form in a portion of the roof that is between an anterior region of the roof support and the forwardly located seam. This cavity may pose risk to mine and operator safety as it exposes the mine and the operator/s to a potential risk of the roof collapsing over. It would be prudent to provide support beneath an exposed cavity as soon as possible so that both mine and operator safety can be ensured at all times when undertaking mining activity.

However, as operators of the longwall mining system are typically tasked with the activity of noticing deformities in the coal seam, such as cavity formations in the roof of an underground mine, the operators may suffer from fatigue owing to manual intervention in the process of detecting these deformities. Moreover, the operator's intuition and judgement process in detecting these deformities cannot be fully relied upon. When detecting the presence of cavities, the operator's judgement could be less than accurate, more than adequately erroneous, or delayed due to which the operator would not be able to mitigate the factor of risk to both mine and operator safety.

Hence, there is a need for a roof support for a longwall mining system that overcomes the aforementioned drawbacks and provides improved mine and operator safety.

SUMMARY OF THE DISCLOSURE

In an aspect of the present disclosure, a control system is provided for autonomously controlling movement of a roof support associated with a longwall mining system. The roof support has a base, at least one hydraulic actuator whose one end is pivotally coupled to the base, and a canopy portion that is connected to another end of the hydraulic actuator and pivotally coupled to the base by an intermediate pivoting link member. The control system includes at least one load sensor disposed on the canopy portion. The at least one load sensor is configured to generate a signal indicative of an amount of load borne by the canopy portion in abutment with a roof of an underground mine site. The control system also includes a controller that is communicably coupled to the at least one load sensor and the at least one hydraulic actuator of the roof support. The controller is configured to determine if the signal indicative of the amount of the load borne by the canopy portion is suggestive of a cavity adjacent to a zone above the canopy portion. Based on the determination, the controller is configured to actuate movement of the at least one hydraulic actuator for causing movement of the roof support such that the canopy portion is displaced into a position underlying the cavity.

In another aspect of the present disclosure, a self-advancing roof support for a longwall mining system includes a base, at least one hydraulic actuator having one end pivotally coupled to the base, and a canopy portion that is connected to another end of the hydraulic actuator and pivotally coupled to the base by an intermediate pivoting link member. The self-advancing roof support also includes at least one load sensor disposed on the canopy portion. The at least one load sensor is configured to generate a signal indicative of an amount of load borne by the canopy portion in abutment with a roof of an underground mine site. The self-advancing roof support further includes a controller that is communicably coupled to the at least one load sensor and the at least one hydraulic actuator of the roof support. The controller is configured to determine if the signal indicative of the amount of the load borne by the canopy portion is suggestive of a cavity adjacent to a zone above the canopy portion. Based on the determination, the controller is configured to actuate movement of the at least one hydraulic actuator for causing movement of the roof support such that the canopy portion is displaced into a position underlying the cavity.

In yet another aspect of the present disclosure, a method is provided for autonomously controlling movement of a roof support associated with a longwall mining system. The roof support has a base, at least one hydraulic actuator having one end pivotally coupled to the base, and a canopy portion connected to another end of the hydraulic actuator and pivotally coupled to the base by an intermediate pivoting link member. The method includes generating, using at least one load sensor disposed on the canopy portion, a signal indicative of an amount of load borne by the canopy portion in abutment with a roof of an underground mine site. The method further includes receiving, by means of a controller communicably coupled to the at least one load sensor, the signal indicative of the amount of load borne by the canopy portion in abutment with the roof of the underground mine site. The method also includes determining, by means of the controller, if the signal indicative of the amount of the load borne by the canopy portion is suggestive of a cavity adjacent to a zone above the canopy portion. Based on the determination, the method also includes actuating movement of the at least one hydraulic actuator, by means of the controller, for causing movement of the roof support such that the canopy portion is displaced into a position underlying the cavity.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts. With reference to the drawings, the claims, and the specification, the present disclosure is directed to a self-advancing roof support for a longwall mining system. More particularly, the present disclosure relates to a control system for autonomously controlling movement of a roof support that is associated with a longwall mining system.

Figure 1:
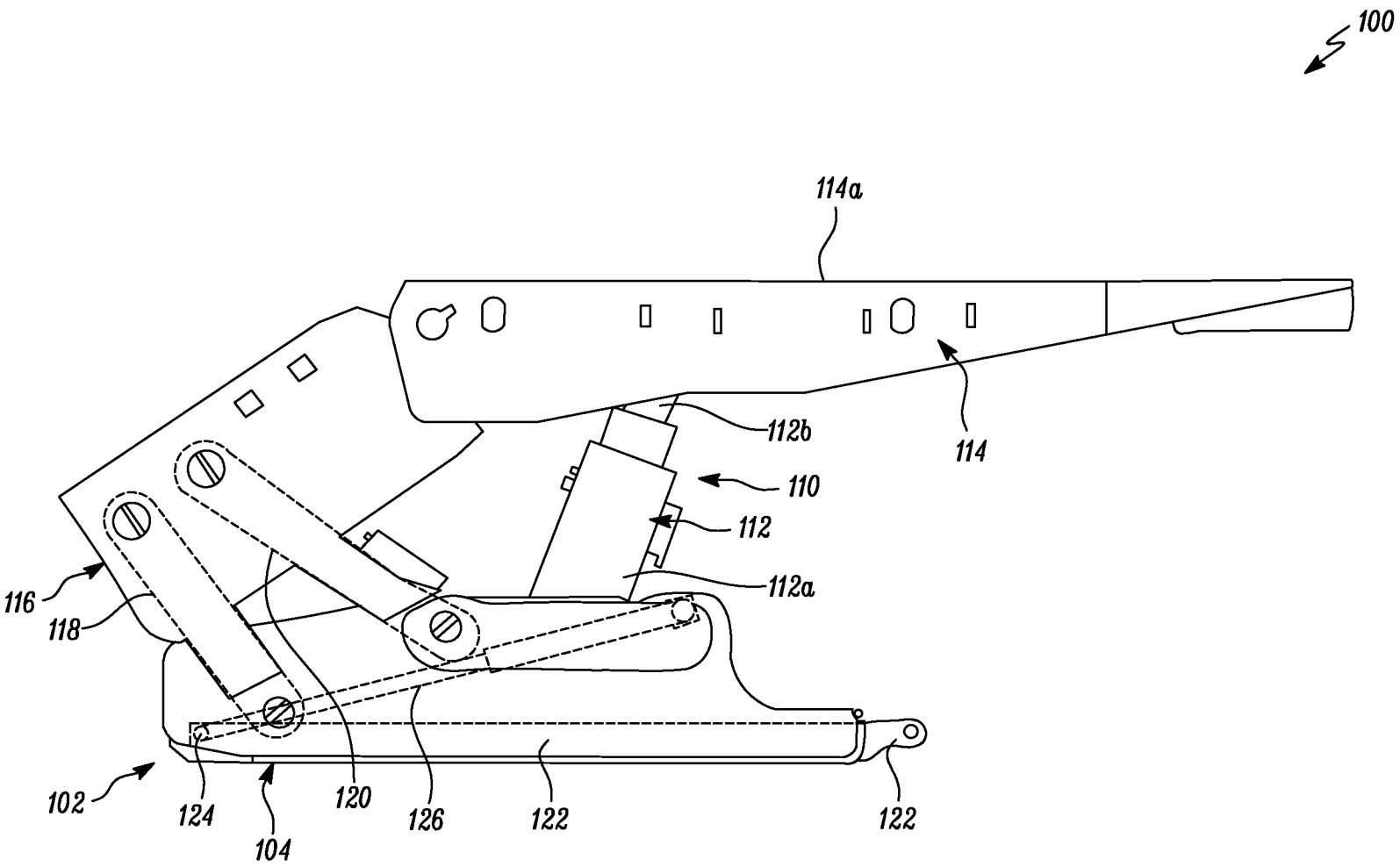
FIG. 1 is a side view of a self-advancing roof support for a longwall mining system, in accordance with an embodiment of the present disclosure.
Figure 2:
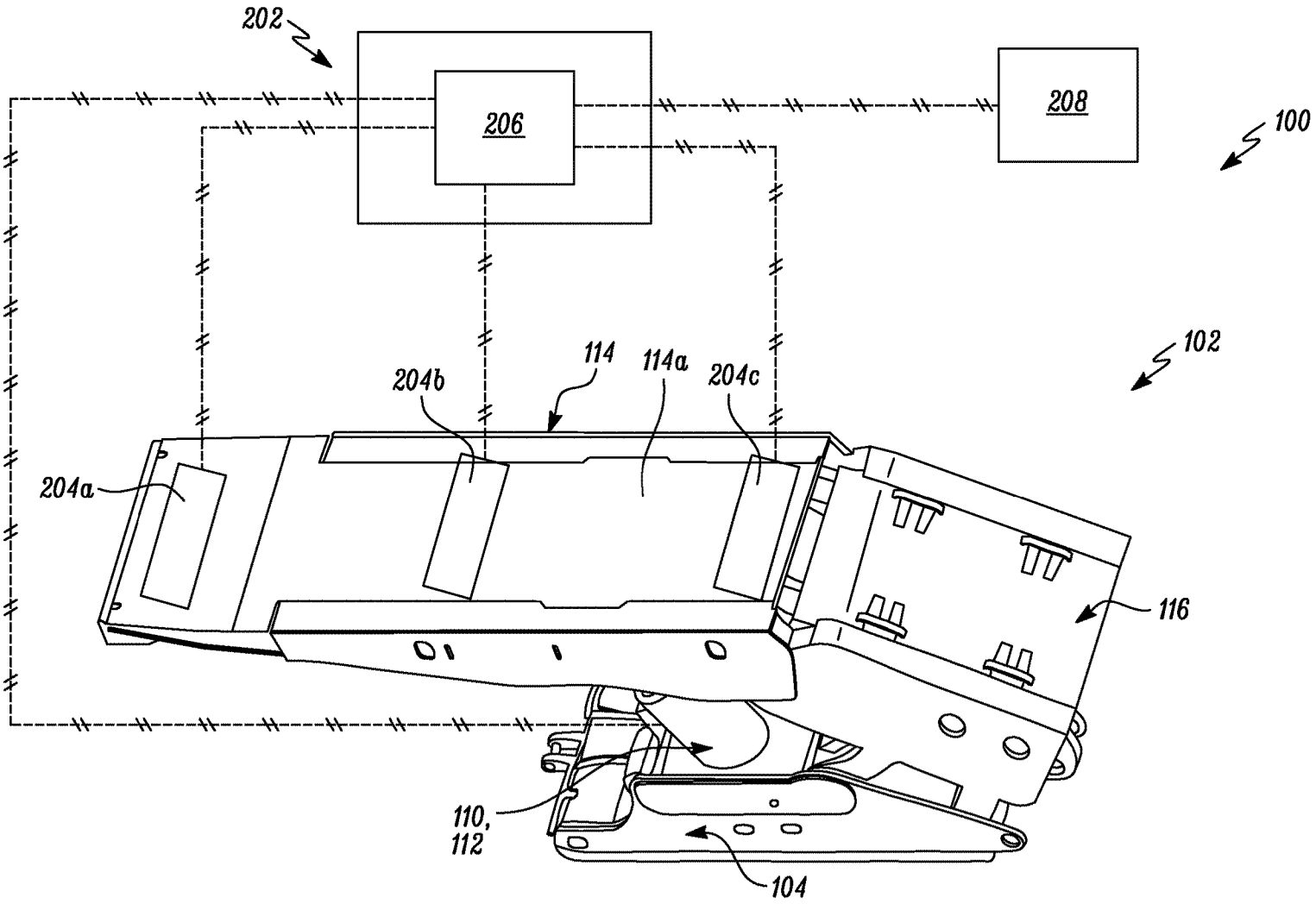
FIG. 2 is a top perspective view of the self-advancing roof support showing schematically a control system having multiple load sensors positioned on a canopy portion of the roof support and a controller coupled to the load sensors and a hydraulic actuator of the roof support, according to an embodiment of the present disclosure.
Figure 3:
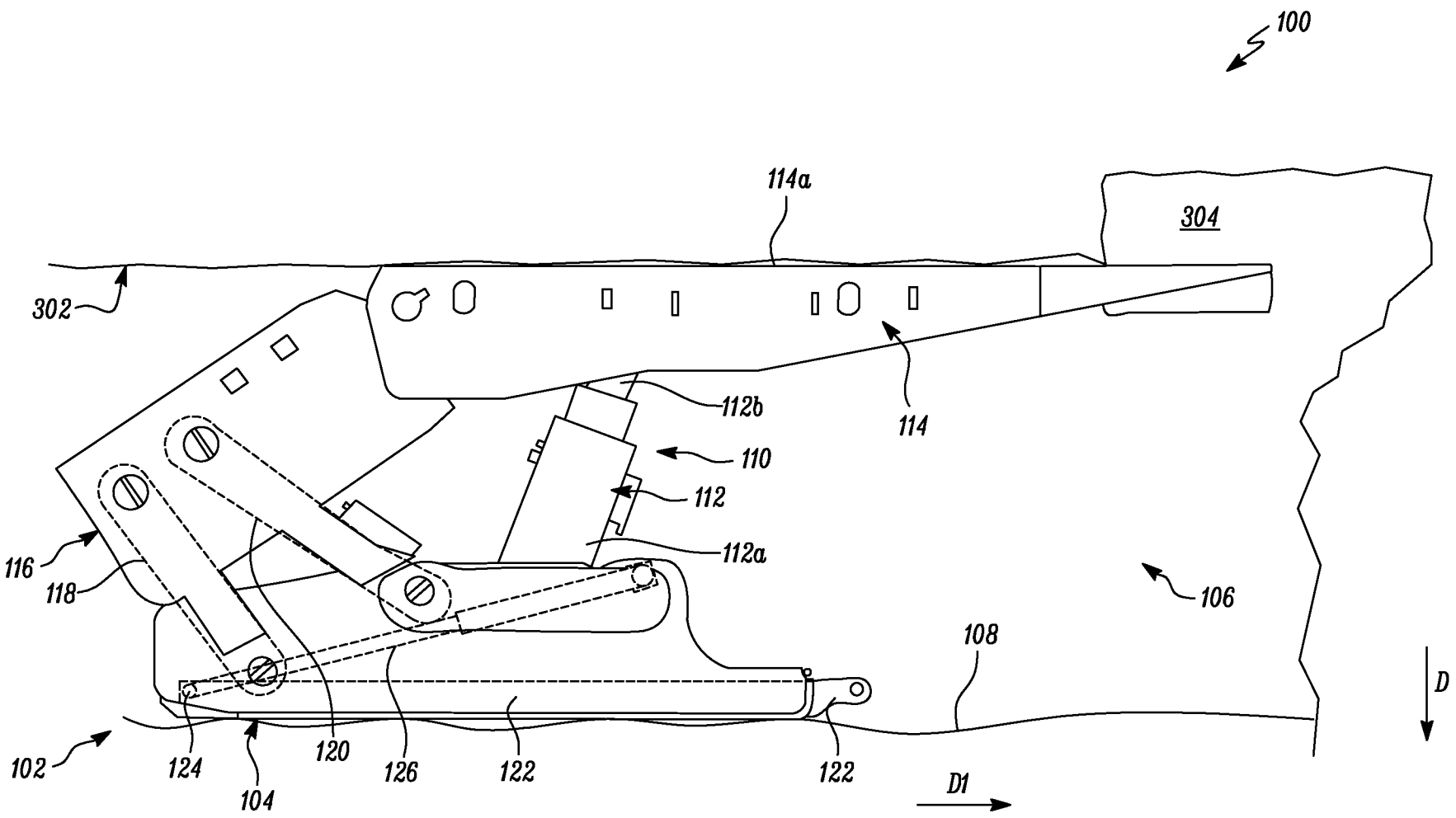
FIG. 3 is a side view of the self-advancing roof support showing an end of the canopy portion in a position adjacent to a cavity in a roof of the mine, according to an exemplary embodiment of the present disclosure.

Referring to FIGS. 1, 2 and 3, a self-advancing roof support 102 (hereinafter referred to as "the roof support 102" and denoted by identical numeral "102") for a longwall mining system 100 is depicted. As shown, the roof support 102 has a base 104. The base 104 would typically be supported on a floor 108 of an underground mine site 106 as shown in the exemplary view of FIG. 3.

The roof support 102 also includes at least one hydraulic actuator 110. As shown in the illustrated embodiment of FIGS. 1, 2, and 3, the at least one hydraulic actuator 110 disclosed herein is embodied in the form of a primary hydraulic actuator 112 whose one end 112*a* is pivotally coupled to the base 104 and another end 112*b* is pivotally coupled to a canopy portion 114 of the roof support 102. Moreover, as shown, the canopy portion 114 is also pivotally coupled to an intermediate pivoting link member 116 which in turn is pivotally connected to the base 104 by, for example, a pair of links 118 and 120 as shown best in the exemplary views of FIGS. 1 and 3.

Although this disclosure is hereinafter explained in conjunction with the primary hydraulic actuator 112, it may be noted that the terms "at least one hydraulic actuator 110" is not limited to the primary hydraulic actuator 112 disclosed herein nor is the roof support 102 of the present disclosure limited in configuration to merely include the primary hydraulic actuator 112 alone therein. In alternative embodiments, the roof support 102 disclosed herein may, additionally, or optionally, include other hydraulic actuators, for example, one or more secondary hydraulic actuators (not shown) to actuate movement of specific components of the roof support 102 relative to one another. In one example, the roof support 102 may include one secondary hydraulic actuator between the canopy portion 114 and the intermediate pivoting link member 116 for moving the canopy portion 114 and the intermediate pivoting link member 116 relative to each other.

Additionally, or optionally, in another example, the roof support 102 may include another secondary hydraulic actuator, for example, a relay bar cylinder 126 that could be located between a bridge (not shown) formed in an anterior portion of the base 104 and a footing 124 of a relay bar 122 that can be operatively commanded by the controller 206 to push an associated segment of a pan line conveyor (not shown) when the canopy portion 114 is in abutment with the roof 302, or can alternatively be commanded by the controller 206 to displace the base 104 relative to the footing 124 of the relay bar 122 and hence, the overall roof support 102 from its initial position on the floor 108 in a direction Di underlying the cavity 304 when the canopy portion 116 is away from the roof 302 of the underground mine site 106. Persons skilled in the art will acknowledge that various configurations of hydraulic actuators may be implemented for use in the roof support 102 of the present disclosure for moving specific components, parts, or portions of the roof support 102 in relation to each other. Therefore, such configurations should be construed as being non-limiting of the present disclosure and falling within the scope of the appended claims for being actuated for movement by the control system 202 disclosed herein, explanation to which will be made hereinafter.

The roof support 102 of the present disclosure includes a control system 202. The control system 202 includes at least one load sensor 204 disposed on the canopy portion 114. The at least one load sensor 204 is configured to generate a signal indicative of an amount of load borne by the canopy portion 114 when in abutment with a roof 302 of the underground mine site 106. Explanation hereinafter will be made in conjunction with a singular load sensor 204. However, it may be noted that such explanation is similarly applicable when multiple load sensors 204 are present, for example, the multiple sensors 204*a*, 204*b*, and 204*c* as shown in the view of FIG. 2. In fact, it is hereby envisioned that when multiple load sensors 204 are used, it may be possible to accurately locate for e.g., by triangulating a position of a cavity 304 on the roof 302 in relation to one or more load sensors 204*a*, 204*b*, and/or 204*c* from the multiple load sensors 204 present on the canopy portion 114.

As shown best in the illustrated embodiment of FIG. 2, the at least one load sensor 204 could be located on a top surface 114*a* of the canopy portion 114. However, in other embodiments, depending on specific requirements of an application, other locations on the canopy portion 114 of the roof support 102 could be suitably selected in lieu of the top surface 114*a* for positioning the at least one load sensor 204 thereon.

In an example as shown in the view of FIG. 2, the control system 202 includes three load sensors 204*a*, 204*b*, and 204*c*. In one embodiment, each of these load sensors 204*a*, 204*b*, and 204*c* could include a load cell. In an alternative embodiment, each of these load sensors 204*a*, 204*b*, and 204*c* could include a strain gauge. Although the load cell and the strain gauge are disclosed herein, such types of load sensors are non-limiting of this disclosure. Persons skilled in the art will acknowledge that the load cell and the strain gauge are just two of many possible configurations of load sensors that are known in the art and other suitable configurations of load sensors known to persons skilled in the art can be readily used to realize functions consistent with the present disclosure. Therefore, it may be noted that other functionally equivalent devices may be implemented as the load sensors 204 for use, in lieu of the load cell or the strain gauge disclosed herein, without deviating from the spirit of the present disclosure.

The control system 202 also includes a controller 206 that is communicably coupled to the at least one load sensor 204 and the at least one hydraulic actuator 110, for example, the primary hydraulic actuator 112 of the roof support 102. In operation, the controller 206 is configured to receive the signal, indicative of the amount of the load borne by the canopy portion 114, from the at least load sensor 204 and determine if the signal, indicative of the amount of the load borne by the canopy portion 114, is suggestive of a cavity 304 adjacent to a zone above the canopy portion 114. If the controller 206 determines that the signal is suggestive of a cavity 304 adjacent to the zone above the canopy portion 114, the controller 206 actuates movement of the at least one hydraulic actuator 110 for causing movement of the roof support 100 such that the canopy portion 114 is displaced into a position underlying the cavity 304. In another embodiment herein, it can also be contemplated that the controller 206 would be configured to actuate movement of the at least one secondary hydraulic actuator, for example, the relay bar cylinder 126 for displacing the base 104 relative to the footing 124 of the relay bar 122 when the canopy portion 114 is away from the roof 302 due to which the overall roof support 102 can be advanced from its initial position on the floor 108 in a direction Di underlying the cavity 304.

It may also be noted that the controller 206 disclosed herein could include various software and/or hardware components configured to perform functions that are consistent with the present disclosure. As such, the controller 206 of the present disclosure may be a stand-alone controller or may be configured to co-operate with an existing electronic control module (ECU) (not shown) of the longwall mining system 100. Furthermore, it may be noted that the controller 206 may embody a single microprocessor or multiple microprocessors that include components for selectively and independently actuating specific system hardware, for example, pumps, solenoids, valves, and other components that are associated with the at least one hydraulic actuator 110.

As exemplarily shown in the view of FIG. 3, the canopy portion 114 is shown displaced into a position underlying the cavity 304. During operation of the roof support 102 disclosed herein, it may be noted that although not absolutely necessary, it would be preferable if the canopy portion 114 is disposed generally in a horizontal orientation i.e., transverse to a direction D in which gravity acts as orientations other than the horizontal orientation of the canopy portion 114 could be less than optimum in providing an equal and opposite reactionary force for adequately supporting a weight associated with the roof 302 of the underground mine site 106. However, orientations other than the horizontal orientation are possible, and hence, the horizontal orientation should not be construed as being limiting of the present disclosure. Rather, embodiments of the present disclosure are directed towards supporting the weight of the roof 302 adequately and promptly as soon as the controller 206 determines from the signal output from the at least one load sensor 204 that the load borne by the canopy portion 114 of the roof support 102 is suggestive of a cavity 304 in a zone adjacent to the canopy portion 114.

Further, in an embodiment as shown in FIG. 2, a notification device 208 may be communicably coupled to the controller 206. This notification device 208 may include, for example, a Graphical User Interface having a display device (not shown). In this embodiment, the controller 206 would be configured to notify an operator, via the notification device 208, of the displacement in the position of the canopy portion 114 relative to the base 104 of the roof support 102. Additionally, or optionally, if other movements are accomplished by the controller 206, for example, if the base 104 is displaced relative to the canopy portion 114, then the controller 206 would also be configured to notify, via the notification device 208, to the operator, the advance in the position of the base 104 relative to the footing 124 of the relay bar 122 when the canopy portion 114 is away from the roof 302 due to which the overall roof support 102 would be advanced from its initial position on the floor 108 in the direction Di underlying the cavity 304.

Figure 4:
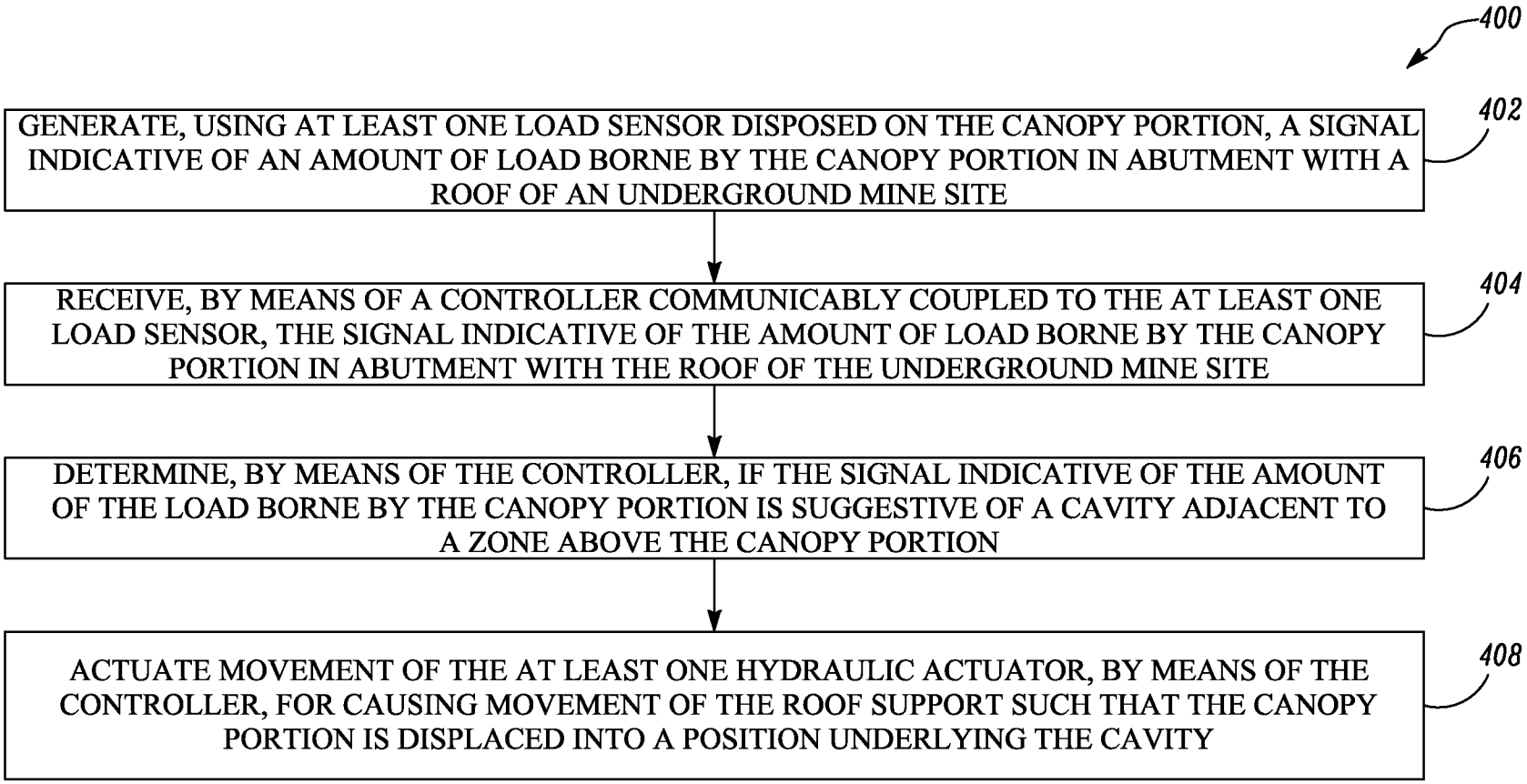
FIG. 4 is a flowchart of a method for autonomously controlling movement of the roof support, according to an embodiment of the present disclosure.

FIG. 4 illustrates a flowchart depicting a method 400 for autonomously controlling movement of a roof support 102 associated with a longwall mining system 100, for example, the roof support 102 of the longwall mining system 100 of FIG. 1. As shown, at step 402, the method 400 includes generating, using the at least one load sensor 204 disposed on the canopy portion 114, a signal indicative of an amount of load borne by the canopy portion 114 in abutment with the roof 302 of the underground mine site 106. Further, at step 404, the method 400 also includes receiving, by the controller 206, the signal indicative of the amount of load borne by the canopy portion 114 in abutment with the roof 302 of the underground mine site 106. Further, at step 406, the method 400 also includes determining, by the controller 206, if the signal indicative of the amount of load borne by the canopy portion 114 is suggestive of a cavity 304 adjacent to a zone above the canopy portion 114. Further, at step 408, the method 400 also includes actuating movement of the at least one hydraulic actuator 110, by the controller 206, for causing movement of the roof support 102 such that the canopy portion 114 is displaced into a position underlying the cavity 304.

Also, in embodiments herein, the method 400 further includes notifying the operator, by the controller 206 via the notification device 208, of the displacement in the position of the canopy portion 114 relative to the base 104. Additionally, or optionally, if the base 104 has been displaced from its initial position, then the method 400 may further include notifying the operator, by means of the controller 206 via the notification device 208, of the advance in the position of the base 104 relative to the canopy portion 114.

INDUSTRIAL APPLICABILITY

Embodiments of the present disclosure have applicability for use in providing a self-advancing roof support that can autonomously support a roof of an underground mine site. In previously known underground mining practices, operators of longwall mining systems would physically i.e., visually inspect the roof of an underground mine site during operation, and subsequently determine a movement of one or more roof supports based on findings from the inspection process. This process of visual inspection was tedious, time-consuming, and costly. Besides, the resultant manual intervention from operators also increased the possibility of making inaccurate and/or delayed judgements when taking decisions for moving the roof support. Such inaccurate and/or delayed judgements could potentially pose a risk to mine and operator safety, for example, if a deformity such a cavity in the roof of the underground mine site is left exposed and could result in an adjoining portion of the roof to cave in i.e., collapse.

With use of the self-advancing roof support disclosed herein, operators of longwall mining systems can be freed up, at least to some extent, from the additional burden and responsibility of having to physically inspect the roof of the underground mine site as mining activity is in progress. Consequently, this could result in a lowering of fatigue that was previously experienced by the operators. Also, the inaccuracies and/or delays in judgements that were incurred with manual intervention from previously known underground mining practices are obviated with the use of the self-advancing roof support of the present disclosure. The self-advancing roof support disclosed herein can autonomously detect not only the presence of a cavity, but also a location of the cavity, and can autonomously move the itself forward to support the roof adjoining the cavity. If movement of other components, for example, the intermediate pivot link member, or any other component is required, the controller disclosed herein would also be configured to move such other components by issuing commands for appropriate movement of the other components. These movements may be commanded by the controller, for execution at respective hydraulic actuators, in a tandem manner so as to represent a sequence of movements or may, alternatively, be executed in a simultaneous manner dictated by other pre-defined logic pre-set at the controller.

With implementation of embodiments disclosed herein, the roof support of the present disclosure overcomes the aforementioned drawbacks typically associated with a manual triggering of movement for the roof supports by operators. With a near real-time movement of the canopy portion, upon detection of a cavity in the roof of the underground mine site, the self-advancing roof support can move autonomously to offer prompt and adequate support to the roof.

While aspects of the present disclosure have been particularly shown and described with reference to the embodiments above, it will be understood by those skilled in the art that various additional embodiments may be contemplated by the modification of the disclosed vehicles, systems and methods without departing from the spirit and scope of what is disclosed. Such embodiments should be understood to fall within the scope of the present disclosure as determined based upon the claims and any equivalents thereof.

What is claimed is:

1. A control system for autonomously controlling movement of a roof support associated with a longwall mining system, the roof support having a base, at least one hydraulic actuator having a first end pivotally coupled to the base, and a canopy portion connected to a second end of the hydraulic actuator and pivotally coupled to the base by an intermediate pivoting link member, the canopy portion being disposed above the base along a vertical direction, the control system comprising:

at least one load sensor disposed on the canopy portion, the at least one load sensor being configured to generate a signal indicative of an amount of load borne by the canopy portion in abutment with a roof of an underground mine site; and a controller communicably coupled to the at least one load sensor and the at least one hydraulic actuator, the controller being configured to:

detect a cavity defined by a surface of the roof based on the signal indicative of the amount of load borne by the canopy portion, the surface of the roof defining the cavity being disposed adjacent to the canopy portion along a horizontal direction, the surface of the roof defining the cavity being disposed at an elevation that is higher than the canopy portion along the vertical direction, the horizontal direction being transverse to the vertical direction, and in response to the detection of the cavity, actuate movement of the at least one hydraulic actuator to displace the canopy portion relative to the base and toward the cavity along the horizontal direction and into a new position directly underlying the surface of the roof defining the cavity.

2. The control system of claim 1, wherein the at least one load sensor is a load cell.

3. The control system of claim 1, wherein the at least one load sensor is a strain gauge.

4. The control system of claim 1, wherein the controller is communicably coupled to a notification device.

5. The control system of claim 4, wherein the controller, via the notification device, is further configured to notify an operator of the displacement in the position of the canopy portion relative to the base.

6. The control system of claim 1, wherein the at least one load sensor is located on a top surface of the canopy portion, the top surface of the canopy portion facing away from the base along the vertical direction and being arranged to directly face the roof of the underground mine site.

7. The control system of claim 4, wherein the controller, via the notification device, is further configured to notify an operator of the advance in the position of the roof support relative to the detected cavity.

8. A self-advancing roof support for a longwall mining system, the self-advancing roof support comprising:

a base;

at least one hydraulic actuator having a first end pivotally coupled to the base;

a canopy portion connected to a second end of the hydraulic actuator and pivotally coupled to the base by an intermediate pivoting link member, the canopy portion being disposed above the base along a vertical direction;

at least one load sensor disposed on the canopy portion, the at least one load sensor being configured to generate a signal indicative of an amount of load borne by the canopy portion in abutment with a roof of an underground mine site; and a controller communicably coupled to the at least one load sensor and the at least one hydraulic actuator, the controller being configured to:

detect a cavity defined by a surface of the roof based on the signal indicative of the amount of load borne by the canopy portion, the surface of the roof defining the cavity being disposed adjacent to the canopy portion along a horizontal direction, the surface of the roof defining the cavity being disposed at an elevation that is higher than the canopy portion along the vertical direction, the horizontal direction being transverse to the vertical direction, and in response to the detection of the cavity, actuate movement of the at least one hydraulic actuator to displace the canopy portion relative to the base and toward the cavity along the horizontal direction and into a new position directly underlying the surface of the roof defining the cavity.

9. The self-advancing roof support of claim 8, wherein the at least one load sensor is a load cell.

10. The self-advancing roof support of claim 8, wherein the at least one load sensor is a strain gauge.

11. The self-advancing roof support of claim 8, wherein the controller is communicably coupled to a notification device.

12. The self-advancing roof support of claim 11, wherein the controller, via the notification device, is further configured to notify an operator of the displacement in the position of the canopy portion relative to the base.

13. The self-advancing roof support of claim 8, wherein the at least one load sensor is located on a top surface of the canopy portion, the top surface of the canopy portion facing away from the base along the vertical direction and being arranged to directly face the roof of the underground mine site.

14. A method for autonomously controlling movement of a roof support associated with a longwall mining system, the roof support having a base, at least one hydraulic actuator having a first end pivotally coupled to the base, and a canopy portion connected to a second end of the hydraulic actuator and pivotally coupled to the base by an intermediate pivoting link member, the canopy portion being disposed above the base along a vertical direction, the method comprising:

generating, using at least one load sensor disposed on the canopy portion, a signal indicative of an amount of load borne by the canopy portion in abutment with a roof of an underground mine site;

receiving, by means of a controller communicably coupled to the at least one load sensor, the signal indicative of the amount of load borne by the canopy portion in abutment with the roof of the underground mine site;

detecting, by means of the controller, a cavity defined by a surface of the roof based on the signal indicative of the amount of load borne by the canopy portion, the surface of the roof defining the cavity being disposed adjacent to the canopy portion along a horizontal direction, the surface of the roof defining the cavity being disposed at an elevation that is higher than the canopy portion along the vertical direction, the horizontal direction being transverse to the vertical direction; and actuating movement of the at least one hydraulic actuator, by means of the controller, for causing movement of the intermediate pivoting link member relative to the base to displace the canopy portion relative to the base and toward the cavity along the horizontal direction and into a new position directly underlying the surface of the roof defining the cavity.

15. The method of claim 14, further comprising notifying, by the controller via a notification device, an operator of the displacement in the position of the canopy portion relative to the base.

16. The method of claim 14, further comprising notifying, by the controller via a notification device, an operator of the advance in the position of the base from its initial position in the direction underlying the cavity.

* * * * *